US006780096B1

(12) United States Patent
Brown et al.

(10) Patent No.: US 6,780,096 B1
(45) Date of Patent: Aug. 24, 2004

(54) SPIRAL WOUND ABRASIVE BELT AND METHOD

(75) Inventors: Ross A. Brown, Glenmore Park (AU); Robert A. Follensbee, Oakdale, MN (US); Stephen J. Yoos, Andover, MN (US); Douglas C. Hunt, Miltona, MN (US); Gary L. Heacox, Elk River, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 168 days.

(21) Appl. No.: 09/598,178

(22) Filed: Jun. 21, 2000

(51) Int. Cl.[7] ..... B24D 11/02; B24D 11/06

(52) U.S. Cl. ..... 451/535; 451/537; 51/297; 57/303; 156/189; 156/304.1; 242/472.5; 242/530.1

(58) Field of Search ..... 28/176; 51/295, 51/297, 298; 57/71, 78, 92, 98, 99, 303, 305, 313; 156/162, 189, 190, 340.1; 242/472.5, 530, 530.1, 530.2, 530.4; 451/526, 533, 535, 537, 539, 536; 428/112; 474/253, 254, 262

(56) References Cited

U.S. PATENT DOCUMENTS

| | | | | |
|---|---|---|---|---|
| 2,189,754 A | | 2/1940 | Cherrington | |
| 2,682,733 A | * | 7/1954 | Buckner | 451/535 |
| 2,743,559 A | | 5/1956 | Ball et al. | |
| 3,972,468 A | * | 8/1976 | Reid | 206/830 |
| 3,982,686 A | * | 9/1976 | Parlour et al. | 206/459.5 |
| 4,018,574 A | | 4/1977 | Dyer | |
| 4,039,303 A | | 8/1977 | Yasushi et al. | |
| 5,529,590 A | | 6/1996 | Ennis et al. | |
| 5,700,188 A | * | 12/1997 | Uhlmann et al. | 451/526 |
| 5,863,847 A | | 1/1999 | DeVoe et al. | |

FOREIGN PATENT DOCUMENTS

| | | |
|---|---|---|
| CH | 390 717 | 8/1965 |
| DE | 25 20 297 | 11/1976 |
| EP | 0497 451 A2 | 8/1992 |
| EP | 0 626 238 A1 | 11/1994 |
| WO | WO 97/07936 | 3/1997 |

* cited by examiner

*Primary Examiner*—Timothy V. Eley

(57) ABSTRACT

A spiral wound abrasive belt is formed from an abrasive media including a plurality of webs. The webs of the abrasive media may include coated abrasives joined by splicing media or other suitable joining material. Alternatively, the webs may include individual single or multiple layers that form a coated abrasive simultaneously along with the spiral belt without the use of additional joining material. A method of forming the spiral belt includes draping the abrasive media over a fixed hub at an angle to form the spiral belt while abutting the edges of the outermost web and overlapping the outermost web and adjacent web or webs. Heat and pressure may be applied to the joined edges to form a strong bond along the spiral seam. Another method includes introducing the webs forming the abrasive media at an angle and draping the webs over a fixed hub. The abrasive media may then be passed around an adjustable hub that provides tension in the spiral belt while allowing for different circumferentially sized belts. Continuous feeding of the input abrasive media or webs will result in a spiral belt of ever increasing width that may subsequently be slit to a desired width.

45 Claims, 8 Drawing Sheets

SPIRAL WOUND ABRASIVE BELT AND METHOD

FIELD OF THE INVENTION

This invention relates to spiral wound abrasive belts, and methods and apparatus for making the same.

BACKGROUND OF THE INVENTION

Endless coated abrasive articles, such as belts, sleeves, tubes and the like, are used in a variety of abrading operations, especially in the woodworking and metal finishing industries. These operations require that the articles be made and supplied by the coated abrasive manufacturer in a large variety of widths and circumferences.

Standard belt forming techniques provide coated abrasive belts in widths equal to the widths of the coated abrasive materials from which they are formed. Typically, a piece of coated abrasive material, equal in width to the desired belt width, is cut at a suitable angle across its width. The piece of material is then measured to a length equal to the desired belt circumference plus an allowance for forming a lap joint, if desired. A second cut across the width is then made at the same angle as the first cut. An adhesive composition is then applied to one or both ends and the ends are joined by overlapping, causing the ends to adhere to one another by means well known to those skilled in the art.

Alternatively, the piece of coated abrasive material may be cut to a length without an allowance for a lap joint. In this situation, the ends of the material are butted and joined to one another with an overlapping reinforcing flexible patch suitably adhered to the backside of the two ends of the material.

Another alternative method for making a coated abrasive belt is disclosed in European Patent Application. No. 0497451, published Aug. 5, 1992, wherein the method provides a coated abrasive belt that includes an abrasive layer bonded to a flexible backing material, which in turn includes a flexible support and a layer of hot-melt adhesive. A butt joint is formed at the ends of a strip of the material with heat and pressure added to cause the hot-melt adhesive to flow across the joint.

Coated abrasive belts in widths greater than the width of the coated abrasive material have been produced by a number of methods. One such method involves piecing together segments of coated abrasive material to form wide, multi-jointed sectional belts that cover a broad range of belt widths and belt circumferences. These belts, however, have the drawback of increased cost due to the multiple piecing and joining processes required to fabricate the belts. In addition, multiple joints increase the potential for problems due to weakening of the belt at the joints, as well as process control and quality issues.

Another method of forming an endless coated abrasive belt that has a width greater than the width of coated abrasive material from which it was made involves spiral winding of material. A conventional method for making such "spiral wound" belts involves winding an inner liner spirally on a mandrel having an outer circumference equal to the inside circumference of the desired abrasive belt, applying an adhesive to the outer surface of the inner liner, and winding spirally over the adhesive layer a strip of coated abrasive material. Such a method is widely used for the fabrication of belts in smaller sizes, up to, for example, 6 inches in diameter or 19 inches in circumference.

Another such method involves spiral winding narrow strips of coated abrasive material having scarfed (or angle cut) edges that overlap and are adhered using conventional techniques. Alternatively, the edges of a piece of wider coated abrasive material may be formed to abut when wound spirally within a revolvable drum. Subsequently, a resinous coating material is applied to the inner periphery of the belt which then spreads, as the drum revolves, to form a continuous layer of resinous coating that joins the belt material together. Yet another method involves spiral winding about a mandrel a coated abrasive material with abutting edges that has a flexible backing material including a layer of hot-melt adhesive. The spiral wound material is then heated to cause the hot-melt adhesive to flow across the abutted edges resulting in a continuous layer that secures the edges together.

There are numerous shortfalls in the methods described above. Use of a fixed mandrel or drum limits the belts formed on such mandrel or drum to a single diameter. Use of thinner material with these methods makes it difficult to line up the seams and traditional cloth abrasive media may have baggy edges that form puckers or uneven seams in the belt, both of which can cause processing and belt performance problems later on. These methods are usable to form belts one at a time, making them inefficient, less productive and more expensive. In addition, the types of abrasive materials usable with these methods are not typically sufficiently reinforced, such that the resulting abrasive belts tend to delaminate at the seams or during use over time.

An ongoing need exists for spiral wound abrasive belts that are produced in a faster, cheaper and more efficient manner, and in a variety of sizes. Such spiral wound belts that take advantage of abrasive media constructions that produce stronger and more durable abrasive articles are also desirable.

SUMMARY OF THE INVENTION

The present invention is a spiral wound abrasive belt formed from an abrasive media including a plurality of webs, and a method and apparatus for constructing the same. The webs of the abrasive media may include coated abrasives joined by splicing media or other suitable joining material. Alternatively, the webs may include individual single or multiple layers that form a coated abrasive simultaneously along with the spiral belt without the use of additional joining material.

In one embodiment, the abrasive media may be draped over a fixed hub at an angle to form the spiral belt while abutting the inner edge of the spirally wrapped web with the outer edge of the succeeding wrap of web. Heat and pressure may be applied to the joined edges to form a strong bond along the spiral seam. In another embodiment, the webs forming the abrasive media may be introduced at an angle and draped over a fixed hub. The abrasive media may then be passed around an adjustable hub that provides tension in the spiral belt while allowing for different circumferentially sized belts. Continuous feeding of the input abrasive media or webs will result in a spiral belt of ever increasing width that may subsequently be slit to a desired width. Optionally, an outermost web positioning system, including sensors, a controller and a web positioning mechanism may be provided to minimize gaps or overlaps along the spiral seam.

DETAILED DESCRIPTION OF THE INVENTION

Figure 1:
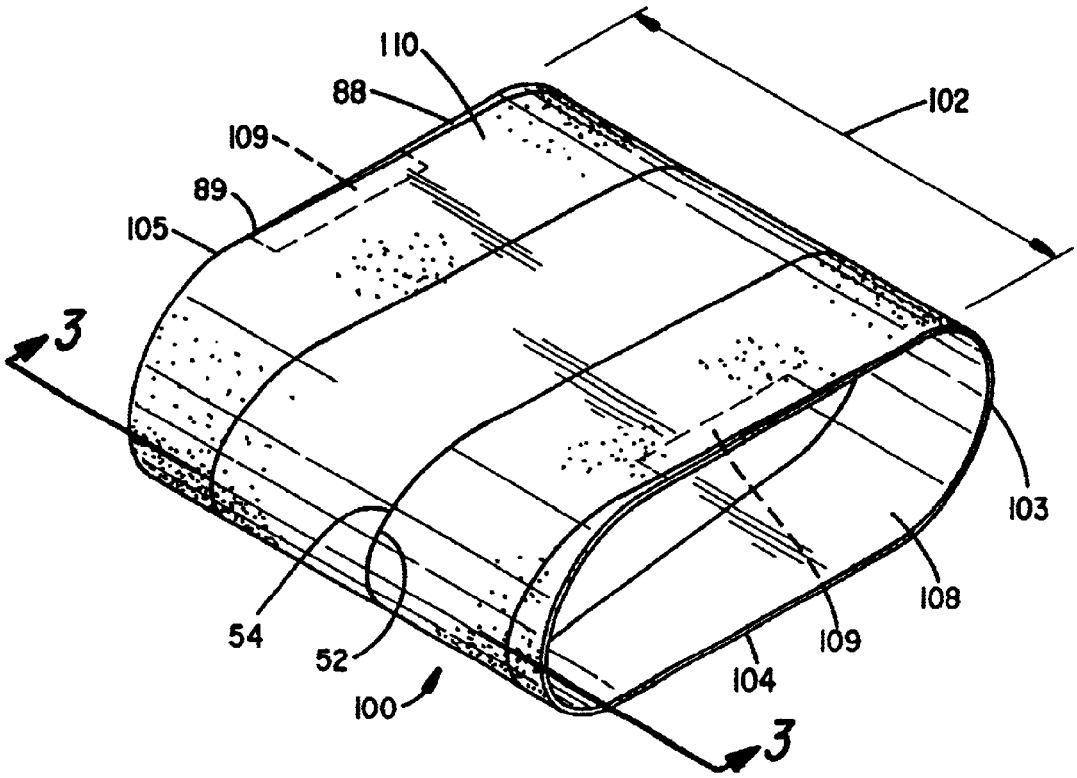
FIG. 1 is a perspective view of one embodiment of a spiral wound abrasive belt formed in accordance with the present invention.

With reference to the attached Figures, it is to be understood that like components are labeled with like numerals throughout the several Figures. FIG. 1 is a spiral abrasive belt 100 formed in accordance with the present invention for use on a polisher, sander, grinder or other rotating machine using an abrasive surface. The spiral belt 100 has a width 102 and a circumference 103. The spiral belt 100 also has first and second belt ends 104 and 105, respectively, an inner surface 108 and an outer surface 110. The inner and outer surfaces 108, 110 are preferably continuous such that there is no appreciable beginning or end to the belt 100 while it rotates over a surface being processed.

Figure 2:
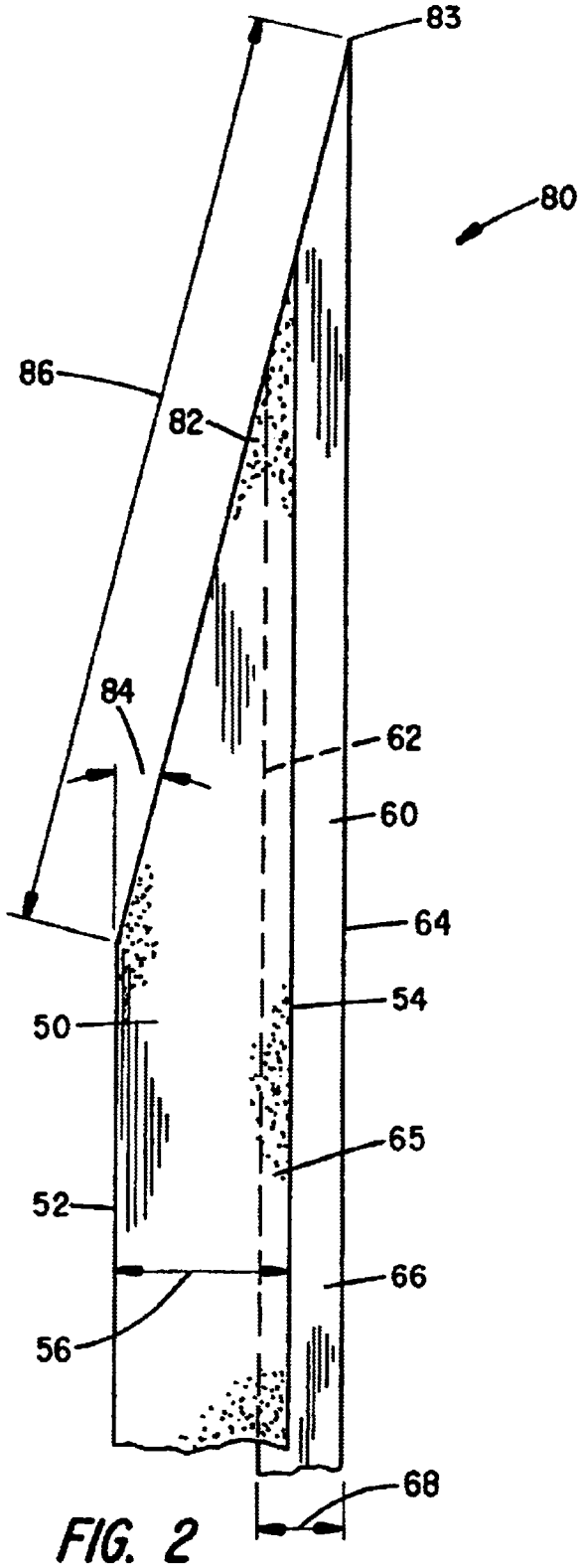
FIG. 2 is a plan view of an abrasive media including two webs for use in the formation of the spiral wound abrasive belt of FIG. 1.

FIG. 2 is an abrasive media 80 that may be used to form the spiral belt 100, in accordance with the present invention. The abrasive media 80 includes a first web 50 having a width 56, and first and second side edges 52 and 54, respectively, along the web length. The first and second side edges 52, 54 are preferably parallel to one another. In this embodiment, the abrasive media 80 also includes a second web 60 that has a width 68 and parallel first and second side edges 62 and 64, respectively. The first web 50 overlaps a first portion 65 of the second web 60 along the length leaving a second portion 66 of the second web 60 exposed. As shown, the second portion 66 is sized to be about one-half the width 68 of the second web 60, although it may be smaller or larger if desired.

The abrasive media 80 has a first end 82 formed or cut at an angle 84 to the web side edges 52, 54, 62, 64. The angle 84 and thus the length 86 of the first end 82 may vary depending on the desired dimensions of the spiral belt 100. In one embodiment, the first end length 86 determines the circumference 103 of the spiral belt 100, so that changes in angle 84 and length 86 will provide larger or smaller belts as desired for a particular application. In another embodiment, a pre-cut angled edge 84 is not required. The resulting spiral belt 100 may be trimmed as needed to provide an even first belt end 104. In this embodiment, the angle of winding and width 56 of the first web 50 (as discussed in more detail below) determine the resulting circumference 103 of the spiral belt 100.

The abrasive media 80 may be configured as a continuous web, thereby forming a spiral belt 100 of ever increasing width, which may then be slit to a desired belt width 102. Alternatively, the abrasive media 80 may be configured to include a second end 88, as shown in FIG. 1, formed parallel to the first end 82, giving the abrasive media 80 a fixed length (not shown). The length of the abrasive media 80 then determines the width 102 of the spiral belt 100.

The spiral belt 100 is formed by winding the abrasive media 80 in a spiral wherein side edge 52 is brought into abutting contact with side edge 54, such that no gap is present. The angle 84 sets the angle of wrap for the spiral belt 100. The angled first end 82 provides a starting point at first tip 83 for the spiral belt 100, as well as the relatively even first belt end 104. In a like manner, the angled second end 88 provides an end point at tip 89 for the spiral belt 100 and second belt end 105 that is also relatively even. The resulting spiral belt 100 has width 102. The first and second belt ends 104, 105 are both preferably configured to be generally perpendicular to the width dimension 102 and generally parallel to each other. For continuous width belts, the second belt end 105 may be formed by slitting the belt 100 at the desired width 102, instead of by a second end 88. Tabs 109 may be provided to secure the angled first and second end tips 83 and 89 to the remainder of the spiral belt 100.

Figure 3:
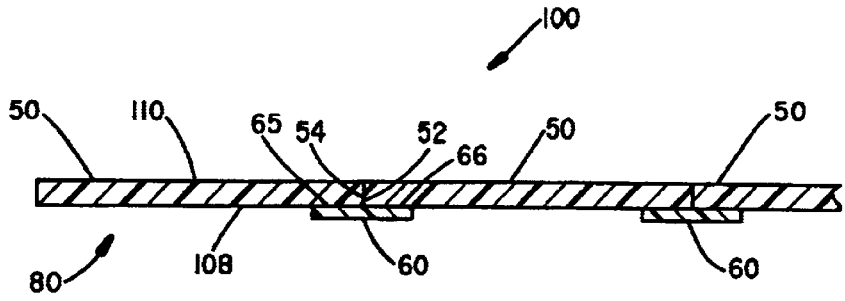
FIG. 3 is a partial cross-sectional view of the spiral wound abrasive belt of FIG. 1.

As the abrasive media 80 winds to form the spiral belt 100, the first web 50 overlaps the exposed second portion 66 of the second web 60. FIG. 3 is a partial cross-sectional view of wound spiral belt 100 showing the resulting relationship between the first and second webs 50 and 60, respectively. In one embodiment, the second web 60 preferably includes an adhesive over the second portion 66, which facilitates joining with the first web 50 during winding to produce the spiral belt 100.

Figure 4:
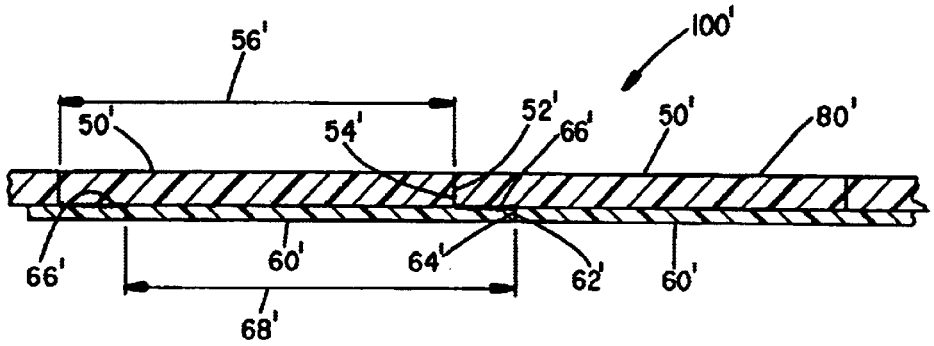
FIG. 4 is a partial cross-sectional view of a second embodiment of a spiral wound abrasive belt formed from an abrasive media including three webs.

The second web 60 may be provided as a narrow strip whose width 68 is appreciably narrower than width 56 of the first web 50, as shown in FIGS. 2 and 3, functioning primarily for the purpose of joining the abutting edges 52 and 54 of the first web 50. As shown in FIG. 4 in a second embodiment of a spiral belt 100' formed from an abrasive media 80', a second web 60' may alternatively be provided in a larger width 68' up to and including a width 56' of a first web 50', positioned an offset amount 66' from the first web 50'. As shown, the offset amount 66' is substantially less than one-half the width 68' of the second web 60', however it may be smaller or larger if desired. The second web width 68' should be no greater than the first web width 56' or else first web edges 52' and 54' will not abut, but will have a gap between them. Alternatively, if the edges 52', 54' did abut without a gap, there would be a bump running around the belt 100' where the second web 60' overlaps itself When the second web width 68' is about equal to the first web width 56', the second web side edges 62' and 64' will also abut without an appreciable gap in a manner similar to the side edges 52', 54' of the first web 50'. In this embodiment, the second web 60' also preferably includes adhesive over the offset portion 66' (applied to either the first or second webs 50', 60') to facilitate joining of the second web 60' to the first web 50'.

Figure 5:
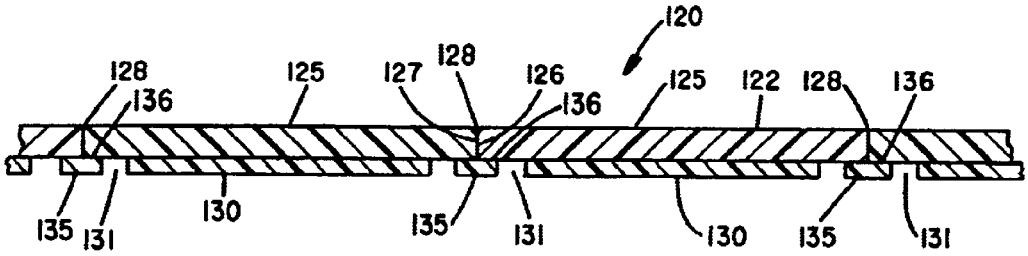
FIG. 5 is a partial cross-sectional view of a third embodiment of a spiral wound abrasive belt formed from an abrasive media including two webs.

Although shown with two webs 50, 60 in FIGS. 1–3, and webs 50' and 60' in FIG. 4, the spiral belt 100, 100' may be formed from more or less webs as needed to produce a spiral belt 100, 100' having the desired properties for a particular application. In FIG. 5, a third embodiment of a spiral belt 120, shown in a cross-sectional view, is formed from an abrasive media 122 including three webs: a first web 125, a second web 130 and a third web 135. In this embodiment, the second web 130 is somewhat narrower than the first web 125 such that the second web 130 is undercut from first web edges 126, 127 leaving a gap 131 adjacent the seam 128 where the edges 126, 127 abut. The third web 135 is then positioned within the gap 131, adjacent the first web 125 and offset from one of the edges 126, 127 a portion 136, such that the third web 135 overlaps and joins the seam 128 when the abrasive media 122 is spirally wound into the belt 120. In this embodiment, the second web 130 may be attached to the first web 125 using many methods, including but not limited to adhesive. The third web 135 preferably includes adhesive at the offset portion 136 (applied to either the first or third webs, 125, 135, respectively) to join the seam 128 of the belt 120.

Preferred adhesives include phenolic resins, aminoplast resins, hot melt resins, latex resins, epoxy resins, ethylene acrylic acid resins, polyvinyl acetate resins, radiation curable resins, urethane resins, and pressure sensitive adhesives.

Adhesives preferably are thermosetting resins. The terms "thermosetting" or "thermoset" refer to reactive systems that irreversibly cures upon application of heat and/or other energy sources, such as E-beam, ultraviolet radiation, visible light, etc., or with time upon the addition of a chemical catalyst, moisture, or the like. The term "reactive" includes components that react with each other (or self react) either by polymerizing, crosslinking, or both. These components are often referred to as resins. The term "resin" refers to polydisperse systems containing monomers, oligomers, polymers, or combinations thereof.

Phenolic resins may be used because of their thermal properties, availability, cost and ease of handling. There are two types of phenolic resins, resole and novolac. Resole phenolic resins have a molar ratio of formaldehyde to phenol, of greater than or equal to one to one, typically between 1.5:1.0 to 3.0:1.0. Novolac resins have a molar ratio of formaldehyde to phenol, of less than one to one.

Suitable phenolic resins preferably include about 70% to about 85% solids, and more preferably about 72% to about 82% solids. The remainder of the phenolic resin is preferably water with substantially no organic solvent due to environmental concerns. If the percent solids is very low, more energy is required to remove the water and/or solvent. If the percent solids is very high, the viscosity of the resulting phenolic resin is too high which may lead to processing problems.

Examples of commercially available phenolic resins include those known under the trade designations "VARCUM" and "DUREZ" from Occidental Chemical Corp., Tonawanda, N.Y.; "AROFENE" and "AROTAP" from Ashland Chemical Company, Columbus, Ohio; "RESINOX" from Monsanto, St. Louis, Mo.; and "BAKELITE" from Union Carbide, Danbury, Conn.

Modified phenolic resins may also be used. For example, a plasticizer, latex resin, or reactive diluent may be added to a phenolic resin to modify flexibility and/or hardness of the cured phenolic binder.

A suitable aminoplast resin has at least one pendant $\alpha,\beta$-unsaturated carbonyl groups per molecule. These unsaturated carbonyl groups may be acrylate, methacrylate or acrylamide type groups. Examples of such materials include N-hydroxymethyl-acrylamide, N,N'-oxydimethylenebisacrylamide, ortho and para acrylamidomethylated phenol, acrylamidomethylated phenolic novolac and combinations thereof.

Suitable epoxide resins include monomeric epoxy resins and polymeric epoxy resins. These resins can vary greatly in the nature of their backbones and substituent groups. Examples of epoxy resins include 2,2-bis[4-(2,3-epoxypropoxyphenol)propane (diglycidyl ether of bisphenol A)] and commercially available materials under the trade designations, "EPON 828," "EPON 1004," and "EPON 1001F," available from Shell Chemical Co., Houston, Tex.; "DER-331," "DER-332," and "DER-334," all available from Dow Chemical Co., Midland, Mich. Other suitable epoxy resins include glycidyl ethers of phenol formaldehyde novolac (e.g., "DEN-431" and "DEN-438" available from Dow Chemical Co., Midland, Mich.). Other epoxy resins include those described in U.S. Pat. No. 4,751,138 (Tumey et al.).

Other suitable adhesives include waterborne acrylic polymers or copolymers, commercially available under the trade designation NEOCRYL; urethane-acrylic copolymers, commercially available under the trade designation NEOPAC; polyurethane resins, commercially available under the trade designation NEOREZ, all available from Zeneca Division of ICI America, Wilmington, Mass.; and acrylic and acrylonitrile latex resins, commercially available under the trade designation HYCAR, available from B. F. Goodrich, Cleveland, Ohio. Still other suitable adhesives include acrylated acrylic or acrylated urethane polymer resins, commercially available under the trade designation NEORAD, available from Zeneca Division of ICI America, Wilmington, Mass.; acrylated polyester resins, commercially available under the trade designation IRR-114, available from UCB Chemical Corp., Atlanta, Ga., and butadiene and butadiene styrene resins.

Further suitable adhesives include a 100% solids blend of vinyl ether monomers and oligomers. Such resins are typically low molecular weight materials which form films by crosslinking upon exposure to UV radiation. Examples of commercially available blends include RAPICURE from ISP, Wayne, N.J.; and VECTOMER from Allied Signal, Morristown, N.J. A catalyst is typically required to initiate crosslinking. A suitable catalyst such as UVI-6990 (a cationic photocatalyst) from Union Carbide, Danbury, Conn., may be used.

Suitable urea-aldehyde resins include any urea or urea derivatives and any aldehydes which are capable of being rendered coatable and have the capability of reacting together at an accelerated rate in the presence of a catalyst, preferably a cocatalyst.

Acrylate resins include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Representative examples of acrylate resins include methylacrylate, ethylacrylate, methyl methacrylate, ethyl methacrylate, ethylene glycol diacrylate, ethylene glycol dimethacrylate, hexanediol diacrylate, triethylene glycol diacrylate, trimethylolpropane triacrylate, glycerol triacrylate, pentaerythritol triacrylate, pentaerythritol trimethacrylate, pentaerythritol tetraacrylate and pentaerythritol tetramethacrylate.

A hot melt resin may also be used. Exemplary hot melt resins are described in U.S. Pat. No. 5,436,063 (Follett et al.). Hot melt resins include compositions that are solid at room temperature (about 20–22° C.) but which, upon heating, melt to a viscous liquid that can be readily applied to a backing. Useful hot melt resins include thermoplastics such as polyolefins, polyesters, nylons and ionomer resins (SURLYN from DuPont of Wilmington, Del.).

Other hot melt resins may include blends of thermoplastic resins with thermosetting resins. Thermoplastic resins are typically supplied as pellets and must be melted, pumped and extruded in hot form as a sheet or film. The film can be applied directly to backings with non-contact forming equipment (drop or extrusion dies, for example) or with contact equipment (ROC or rotating rod dies). The extruded coating can be solidified by cooling or it can be crosslinked with ultraviolet (UV) energy if radiation curable components are present in the hot melt. It is also possible to provide the hot melt resins as uncured, unsupported rolls of adhesive film. In this instance, the resin is extruded, cast, or coated to form the film. Such films are useful in transfer coating the resin to a backing.

Figure 6:
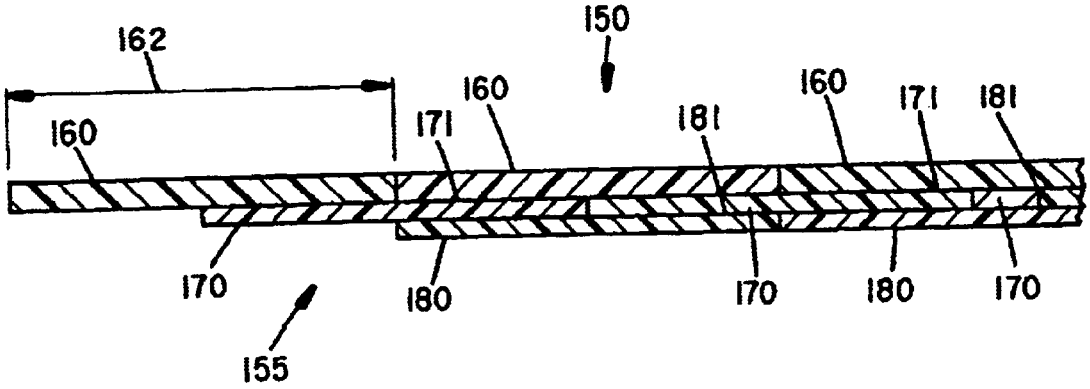
FIG. 6 is a partial cross-sectional view of a fourth embodiment of a spiral wound abrasive belt formed from an abrasive media including three webs.

FIG. 6 is a partial cross-sectional view of a fourth embodiment of a spiral belt 150 formed from a spiral wound abrasive media 155 having three overlapped webs: an outermost web 160, a middle web 170 and an innermost web 180. Each web 160, 170, 180 is shown to be about equal in width 162, with each web 160, 170, 180 offset from the adjacent web or webs about one-half the width 162. As a result, the middle web 170 has a one-half width exposed portion 171 and the innermost web 180 has a one-half width exposed portion 181. As the abrasive media 155 winds to form the spiral belt 150, the first web 160 overlaps the exposed portion 171 of the middle web 170, and the middle web 170 overlaps the exposed portion 181 of the innermost web 180, such that each web 160, 170, 180 produces abutting joints with no appreciable gap. Although four embodiments have been shown and described, it is to be understood that other web configurations for the abrasive media are possible and within the contemplation and scope of the present invention. In addition, although adhesive is described herein as preferred for attachment of the overlapped webs, it is to be understood that other forms of attachment may also be used are and within the scope of the present invention.

As shown, the abrasive media 80, 80', 122 and 155 are preferably configured as a plurality of webs positioned in an adjacent and overlapping manner with respect to each other. The first or outermost webs 50, 50', 125, 160 are preferably coated abrasives formed from one or more layers of material and one or more layers of abrasive particles. Coated abrasives generally comprise a flexible backing upon which a binder supports a coating of abrasive particles. The abrasive particles are typically secured to the backing by a first binder, commonly referred to as a make coat. Additionally, the abrasive particles are generally oriented with their longest dimension perpendicular to the backing to provide an optimum cut rate. A second binder, commonly referred to as a size coat, is then applied over the make coat and the abrasive particles to further anchor the particles to the backing so as to reduce the likelihood of minerals fracturing off during use.

Porous cloth, fabric and textile materials are frequently used as backings for coated abrasive articles. The make coat precursor is typically applied to the backing as a low viscosity material. In this condition, the make coat precursor can infiltrate into the interstices of the porous backing leaving an insufficient coating thickness making it difficult to bond the subsequently applied abrasive particles to the backing and, on curing, resulting in the backing becoming stiff, hard and brittle. As a result, it has become conventional to employ one or more treatment coats, such as a presize, saturant coat, backsize or a subsize coat, to seal the porous backing. Such treatment coats also allow for the use of less expensive backing materials, such as paper, combined with reinforcing materials, as described below, to achieve similar strength and tear resistance as that of more expensive cloth type backings.

The presize, saturant coat, backsize and subsize coat typically involve thermally curable resinous adhesives, such as phenolic resins, epoxy resins, acrylate resins, acrylic lattices, lattices, urethane resins, glue, starch and combinations thereof. A saturant coat saturates the cloth and fills pores, resulting in a less porous, stiffer cloth with more body. An increase in body provides an increase in strength and durability of the article. A presize coat, which is applied to the front side of the backing, may add bulk to the cloth or may improve adhesion of subsequent coatings, or may act as a barrier to excessive make coat penetration. A backsize coat, which is applied to the back side of the backing, i.e., the side opposite that to which the abrasive grains are applied, adds body to the backing and protects the yarns of the cloth from wear. A subsize coat is similar to a saturation coat except that it is applied to a previously treated backing. The drawback of such a presize, saturant coat, backsize and subsize coat is that it entails added processing step(s) which increase the cost and complexity of manufacturing. Similarly, paper backings may be treated to prevent penetration of make adhesives and/or to waterproof.

As described above, a backing may be a conventional, sealed coated abrasive backing or a porous, non-sealed backing. Such a backing may be comprised of cloth, vulcanized fiber, paper, nonwoven materials, fibrous reinforced thermoplastic backing, polymeric films, substrates containing hooked stems, looped fabrics, metal foils, mesh, foam backings, and laminated multilayer combinations thereof Cloth backings can be untreated, saturated, presized, backsized, porous, or sealed, and they may be woven or stitch bonded. The cloth backings may include fibers or yarns of cotton, polyester, rayon, silk, nylon or blends thereof The cloth backings can be provided as laminates with different backing materials described herein. Paper backings also can be saturated, barrier coated, presized, backsized, untreated, or fiber-reinforced. The paper backings also can be provided as laminates with a different type of backing material. Nonwoven backings include scrims and may be laminated to different backing materials mentioned herein. The nonwovens may be formed of cellulosic fibers, synthetic fibers or blends thereof Polymeric backings include polyolefin or polyester films, nylon, SURLYN ionomer or other materials that may be hot-melt laminated. The polymeric backings can be provided as blown film, or as laminates of different types of polymeric materials, or laminates of polymeric films with a non-polymeric type of backing material. The backing can also be a stem web used alone or incorporating a nonwoven, or as a laminate with a different type of backing. The loop fabric backing can be brushed nylon, brushed polyester, polyester stitched loop, and loop material laminated to a different type of backing material. The foam backing may be a natural sponge material or polyurethane foam and the like. The foam backing also can be laminated to a different type of backing material. The mesh backings can be made of polymeric or metal open-weave scrims. Additionally, the backing may be a reinforced thermoplastic backing that is disclosed in U.S. Pat. No. 5,417,726 (Stout et al.).

An additional benefit of the processes and constructions described in this invention is shape retention. After conventional converting processes, coated abrasive belts and disks may change shape or "cup" by as much as 2 inches depending upon the environment of storage conditions for these products. These types of changes are typically caused by the different web components in such products picking up environmental moisture or humidity at different rates. The present spiral process of this invention has flexibility to allow the moisture sensitive web components (typically paper) to be covered or protected from moist or humid air. For example in one embodiment of this invention, a polyester film adhesive carrier also serves as a moisture barrier. The prevention of cupping over a wide range of relative humidity removes the necessity of further treating these types of products in order to meet acceptability requirements."

In the first embodiment, the first web 50 is preferably a coated abrasive that may be formed from one or more layers of abrasive particles and one or more layers of backing material. The second web 60 is preferably a splicing media formed from one or more layers of film coated on at least one side with an adhesive, such as an adhesive polymeric tape, or a coated fabric. The adhesive may be a pressure sensitive adhesive or PSA requiring little or no processing after contact. Alternatively, the adhesive may require thermal or radiation curing to fully complete adhesion between the webs 50, 60. The film may be a polymer film, such as a 0.5 mil polyester film, or a fiber reinforced film.

In the second embodiment, the first web 50' is also preferably a coated abrasive. The second web 60' is preferably a reinforcing backing, as described above, that may be attached to the first web 50' using one of a variety of techniques know in the industry. The area of adhesive on the offset portion 66' may be applied to either the first or second webs 50', 60', respectively, after attachment of the second web 60' or may be applied during such attachment.

In the third embodiment, the first web 125 is also preferably a coated abrasive and the second web 130 is preferably a reinforcing backing. The third web 135 is preferably a splicing media, as described above for the first embodiment. Both the second and third webs 130, 135 may be attached to the first web 125 using one or more known techniques, with the adhesive on the offset portion 136 applied during or after attachment of the webs 130, 135.

In the fourth embodiment, the outermost web 160 may also be a coated abrasive, with the middle web 170 a reinforcing material and the innermost web 180 a splicing media or other suitable joining material. Alternatively, the outermost web 160 is preferably the topmost layer of a coated abrasive, such as an abrasive coated backing material formed from a cloth or paper. However, the outermost web 160 may also include multiple layers of abrasive particles and/or multiple layers of backing material, if desired. The innermost web 180 is preferably the lowermost layer of the coated abrasive, such as a reinforcing material, including a nonwoven or other suitable material that provides strength to the spiral belt 150 without providing a substantial increase in weight. Alternatively, the innermost web 180 may be a hook-and-loop material, foam or other material described above for use as a backing. Optionally, the innermost web 180 may also be multiple layers if desired.

The middle web 170 is preferably an adhesive layer that joins the other layers of the coated abrasive forming the abrasive media 155. In one embodiment, the adhesive layer is formed from adhesive material coated onto both surfaces of a film layer. For example, ethylene acrylic acid, sold as SCOTCHPACK from 3M Company in St. Paul, Minn., is coated on both sides of a 0.5 mil polyester film to form a total layer thickness of 3.5 mil After the webs 160, 170, 180 are brought together, heat (at a temperature in the range of about 260–270° F. to achieve the cure temperature of the adhesive) and pressure are applied to the overlapped portions to activate crosslinking and bond the webs 160, 170, 180 together.

In another example, an ultraviolet (UV) curable resin is coated onto both surfaces of a polyester film layer to form the middle web 170. One formulation of this resin includes 70 parts EPON 828 (epoxy), 30 parts HYTREL 6356 (polyester thermoplastic resin) and 1.5 parts CYRACURE UVI-6974 (triarylsulfonium salt photocatalyst). The mixture is heated to 125–130° C. before being applied to the film. The adhesive is then preferably tackified with UV energy by passing it once beneath a 600 watt/inch Fusion lamp using a D-bulb, a medium pressure, mercury vapor lamp as described by Fusion Systems, Inc., just prior to winding of the spiral belt. Once the middle adhesive layer is tackified, the spiral belt 150 is formed from the three web layers 160, 170, 180. After belt formation, the belt 150 is heated for five minutes at 125° C. to complete the adhesive cure.

In yet another embodiment, the middle web 170 may be formed from an adhesive layer configured as a pre-cast film of adhesive material. Such adhesives may include SURLYN ionomer, a Zn-modified ethylene/methacrylic acid copolymer by DuPont.

In the first embodiment, the coated abrasive first web 50 is formed in one or more processes, the second web 60 splicing media is coated with adhesive and attached to the first web 50 along an edge 52, 54 and then the combined abrasive media 80 is wound to form the spiral belt 100. In a similar manner in the second and third embodiments, the coated abrasive first web 50', 125 is formed in one or more processes, the second reinforcing web 60', 130 is formed in one or more processes, and then the second web 60', 130 is attached to the first web 50', 125. In the second embodiment, the combined abrasive media 80' is then spirally wound to form the belt 100'. In the third embodiment, the third web 135 is formed in one or more processes, an adhesive is applied, and the third web 135 is attached to the first web 125. Afterward, the combined abrasive media 122 is spirally wound to form the belt 120. In the fourth embodiment, on the other hand, the formation of the abrasive media 155 preferably occurs simultaneously with the winding and formation of the spiral belt 150, thereby eliminating numerous processing steps, as well as the need for a splicing media, such as web 60 in the first embodiment or web 135 in the third embodiment. Such simultaneous formation also ensures both a good lamination of the abrasive media 155 and a strongly joined belt 150.

Figure 7:
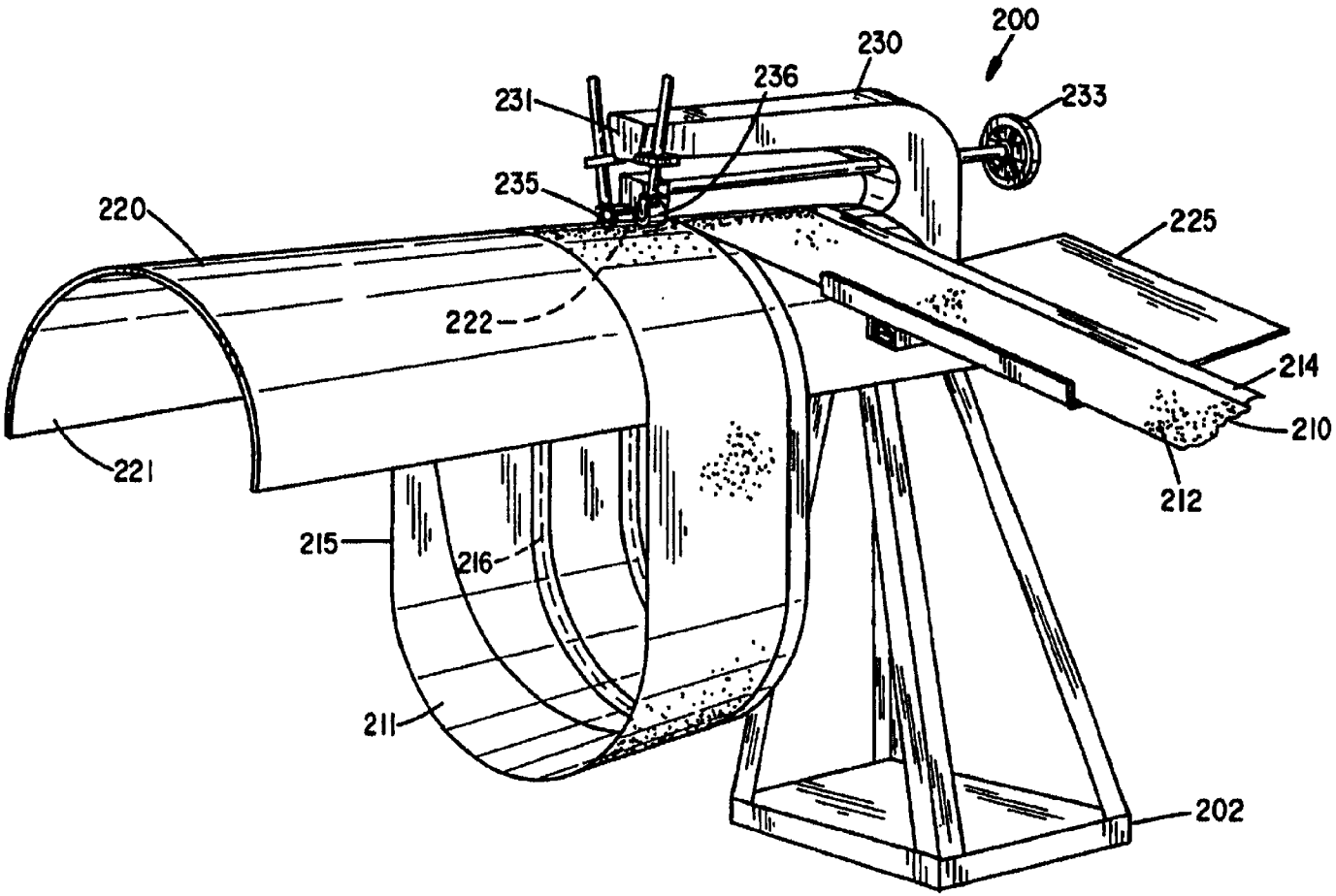
FIG. 7 is a perspective view of one embodiment of a spiral wound abrasive belt forming apparatus.
Figure 8:
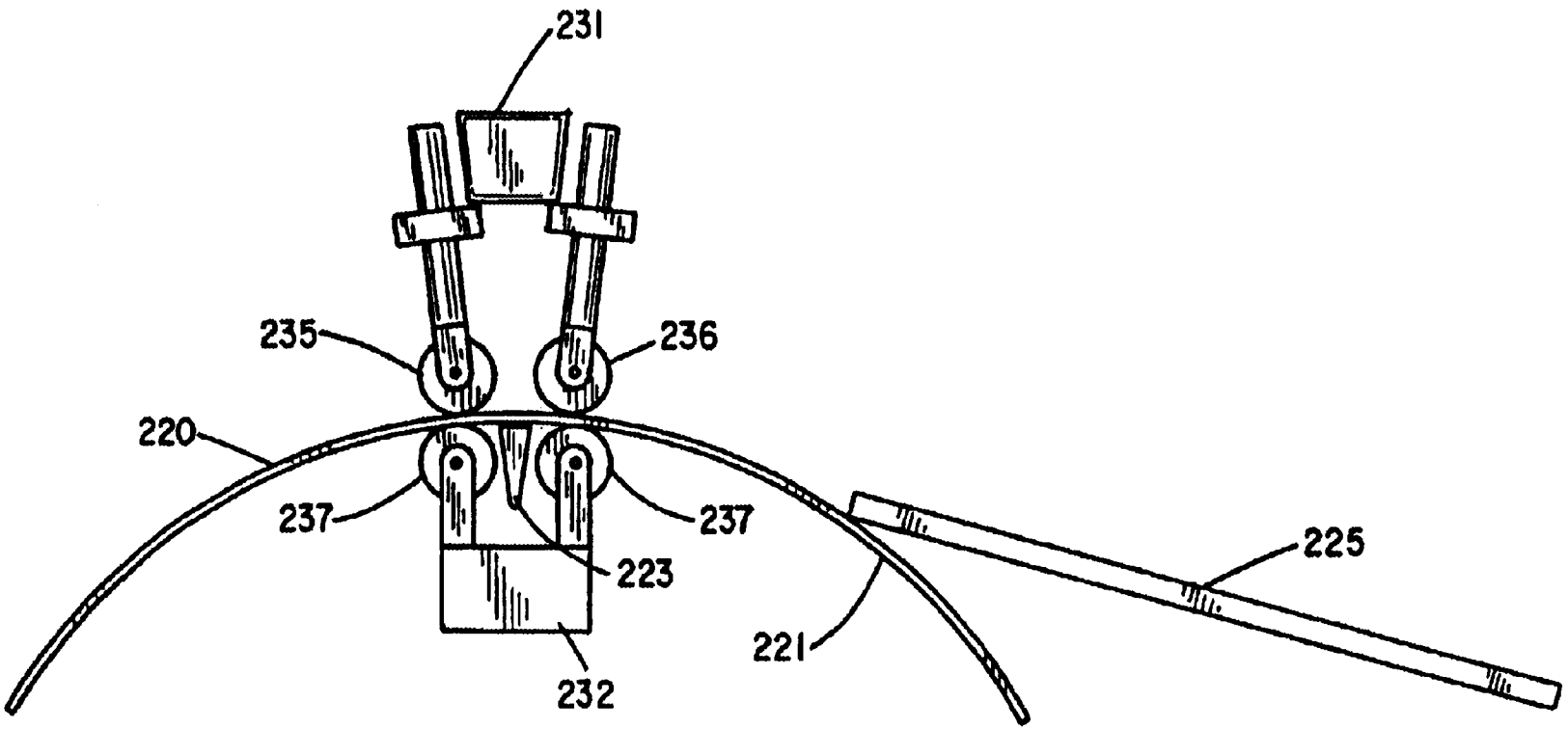
FIG. 8 is a partial end view of the apparatus of FIG. 7.

Formation of the spiral belt 100, 100', 120, 150 from the spiral wound abrasive media 80, 80', 122, 155 may be accomplished in numerous ways. FIGS. 7 and 8 show one embodiment of a spiral wound abrasive belt formation apparatus 200 configured to accept an input abrasive media 210 formed from a first web 212 and a second splicing web 214. The apparatus 200 includes a convexly curved hub 220 over which the abrasive media 210 is draped during the winding process. The hub 220 is supported by the apparatus 200 in a cantilevered manner to allow for continuous formation of a spiral belt 215 of ever increasing width having a spiral seam 216 formed where the edges of the first web 212 abut.

The apparatus 200 also includes a base 202 that supports the hub 220 and a 'C' shaped arm 230. The arm 230 extends out both above and below a portion of the hub 220 and is mounted for pivotal movement with respect to the base 202. At the furthermost upper end 231 of the arm 230 two upper press rollers 235, 236 are mounted for pressure contact with two corresponding lower press rollers 237 that are mounted to the furthermost lower end 232 of the arm 230. An opening 222 formed in the hub 220 adjacent the press rollers 235, 236, 237 allows for contact between the upper press rollers 235, 236 and lower press rollers 237. As the abrasive media 210 passes between the upper and lower press rollers 235, 236, 237, pressure is applied to both the upper and lower surfaces of the seam 216. Mounted on the underside 221 of the hub 220 adjacent the lower press rollers 237 is an optional heating element 223 positioned to radiate heat to the abrasive media 210. Optionally, a light source (not shown) may also be mounted on the underside 221 of the hub 220 at the opening 222 to shine up through seam 216 and thus aid in minimizing gaps at the seam 216.

One of the upper press rollers 235 is configured to be manually driven by rotary mechanism 233. As the abrasive media 210 is fed into the apparatus 200, the rotary mechanism 233 is turned to rotate the driven press roller 235 and thus pull the abrasive media 210 through the apparatus. In this embodiment, the remainder of the press rollers 236, 237 are not driven. Although configured with a manual drive, it is to be understood that the apparatus 200 may alternatively be configured with a powered drive, with or without control.

The apparatus 200 also includes a guide tray 225. The guide tray 225 is adjustably mounted to support the input abrasive media 210 at a desired height and angle with respect to the hub 220.

Prior to input into the apparatus 200, the abrasive media 210 is constructed from webs 212 and 214. An angled leading edge or end 211 may be pre-cut into the abrasive media 210.

The apparatus 200 is then set up to form a spiral belt 215 having a desired width and circumference from pre-constructed abrasive media 210. The angle of the guide tray 225 with respect to the hub 220 establishes the angle at which the spiral belt 215 is wound and, thus, the size of the belt 215. Therefore during set up, the guide tray 225 is positioned at a desired angle with respect to the hub 220. The press rollers 235, 236, 237 facilitate joining of the first web 212 to the second web 214 by providing pressure to the abrasive media 210 as the seam 216 is formed. Therefore, during set up, the arm 230 is also pivoted to position the press rollers 235, 236, 237 at the desired angle to follow the abrasive media 210 as it is input from the guide tray 225. In addition, the pressure exerted by the upper press rollers 235, 236 against the lower press rollers 237 may be adjusted based on the requirements of the abrasive media 210 forming the spiral belt 215, and heat to soften or cure the adhesive may be supplied as needed from optional heater 223.

In operation, the abrasive media 210 is fed into the apparatus 200 along the guide tray 225 and over the hub 220. The leading end or edge 211 is wrapped around the hub 220 and is fed back into the apparatus 200 at the press rollers 235, 236, 237 to start formation of the seam 216 and, thus, the spiral belt 215. Preferably, a first operator feeds the abrasive media 210 into the apparatus 200 while monitoring and attempting to minimize any gap at the seam 216. A second operator manually drives the driven press roller 235 using the rotating mechanism 233, thereby continuously feeding the abrasive media 210 into the apparatus and applying pressure at the press rollers 235, 236 237 to the first web 212 as it overlaps the second web 214 at the seam 216 to bond the webs 212, 214 together. Heat may also be provided by the optional heater 222, if available and desired, to facilitate bonding of the webs 212, 214. The abrasive media 210 continues to be fed into the apparatus 200 and wrapped over the hub 220.forming the spiral belt 215 until a spiral belt 215 of desired width has been formed or until a second end (not shown) of the abrasive media 210 is reached. Once the spiral belt 215 is completed, tabs (such as tabs 109 in FIG. 1) may be applied to maintain adherence of the abrasive media 210 at both ends.

Figure 9:
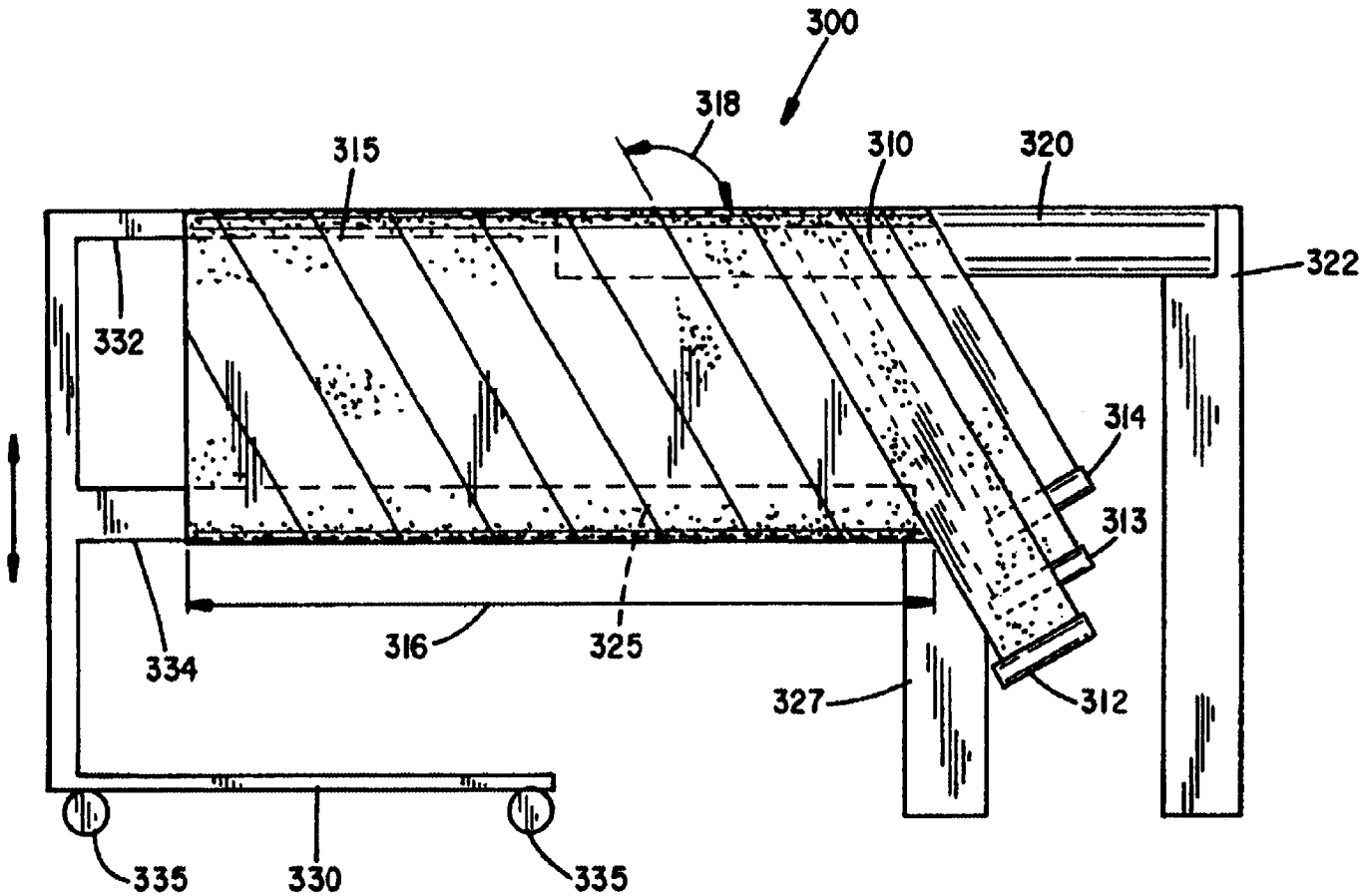
FIG. 9 is a schematic illustration of another embodiment of a spiral wound abrasive forming apparatus.

FIG. 9 shows another embodiment of a spiral wound abrasive belt formation apparatus 300 configured to accept a plurality of webs, such as webs 312, 313, 314, that simultaneously form the abrasive media 3 10 and the spiral belt 3 15. It is to be understood, however, that more or less webs may be used to form the abrasive media and spiral belt, if desired. As described above, the outermost web 312 is preferably a coated abrasive, the middle web 313 is preferably an adhesive layer, and the innermost web 314 is preferably a reinforcing layer. The three webs 312, 313, 314 are wound over a stationary first hub 320 mounted to a first support system 322 in a cantilevered manner.

The three webs 312, 313, 314 are presented at an angle 318 relative to the first hub 320. The angle 318 may be adjusted to accommodate different dimensions of the webs 312, 313, 314 and the spiral belt 315. A web steering system including a steering roller (not shown) or other suitable device may be included to control the presentation of one or more of the webs. The webs 312, 313, 314 are also presented to be partially overlapping, such that during winding of the spiral belt 315, each web's edges abut, preferably without appreciable gaps, forming three relatively continuous layers (see the fourth spiral belt embodiment in FIG. 6).

The splice angle of the spiral webs may be controlled by the width of the input rolls of the abrasive web or materials in order to provide preferred non-marking properties. For example, in a 52 inch×103 inch belt, the typical splice angle is 71°, when the splice is made with the use of conventional belt cutting devices and belt presses. With the spiral belt process, and using a 12 inch wide input roll, the splice angle of the spiral wrap would be 6.7°. Smaller splice angles are preferred by customers where splice marking and loading are generally the normal useful life endpoints of the abrasive belt. The splice angle may also be controlled by selecting different widths of input rolls of abrasive web. For example, for a 52 inch×103 inch belt, the splice angle may be adjusted from 6.7–20.5° by varying the width of the input rolls from 12 inches to 36 inches.

After passing over the first hub 320, the abrasive media 310 passes around a second hub 325 moveably mounted to a second support system 327. The second hub 325 maintains the spiral belt 315 in tension and is adjustable toward and away from the first hub 320 in order to accommodate a wide range of spiral belt circumferences. The second hub 325 is also preferably configured as a drive roller that automatically feeds the abrasive media 310 to continuously form the abrasive media 310 and spiral belt 315 from the webs 312, 313, 314.

As the spiral belt 315 is formed, the spiral belt width 316 continues to increase. In this embodiment, a belt cart 330 is provided to accept the formed spiral belt 315 from the apparatus 300 and support the widening spiral belt 315. The belt cart 330 includes a first belt support 332 set at a height equivalent to the height of the first hub 320. Also included on the cart 330 is a second belt support 334 moveably mounted, such that it may be adjusted to a height equivalent to that of the second hub 325. The belt cart 330 also includes casters 335, or other mechanism for moving the cart 330 toward and away from the apparatus 300 to accommodate the changing width 316 of the belt 315.

Figure 10:
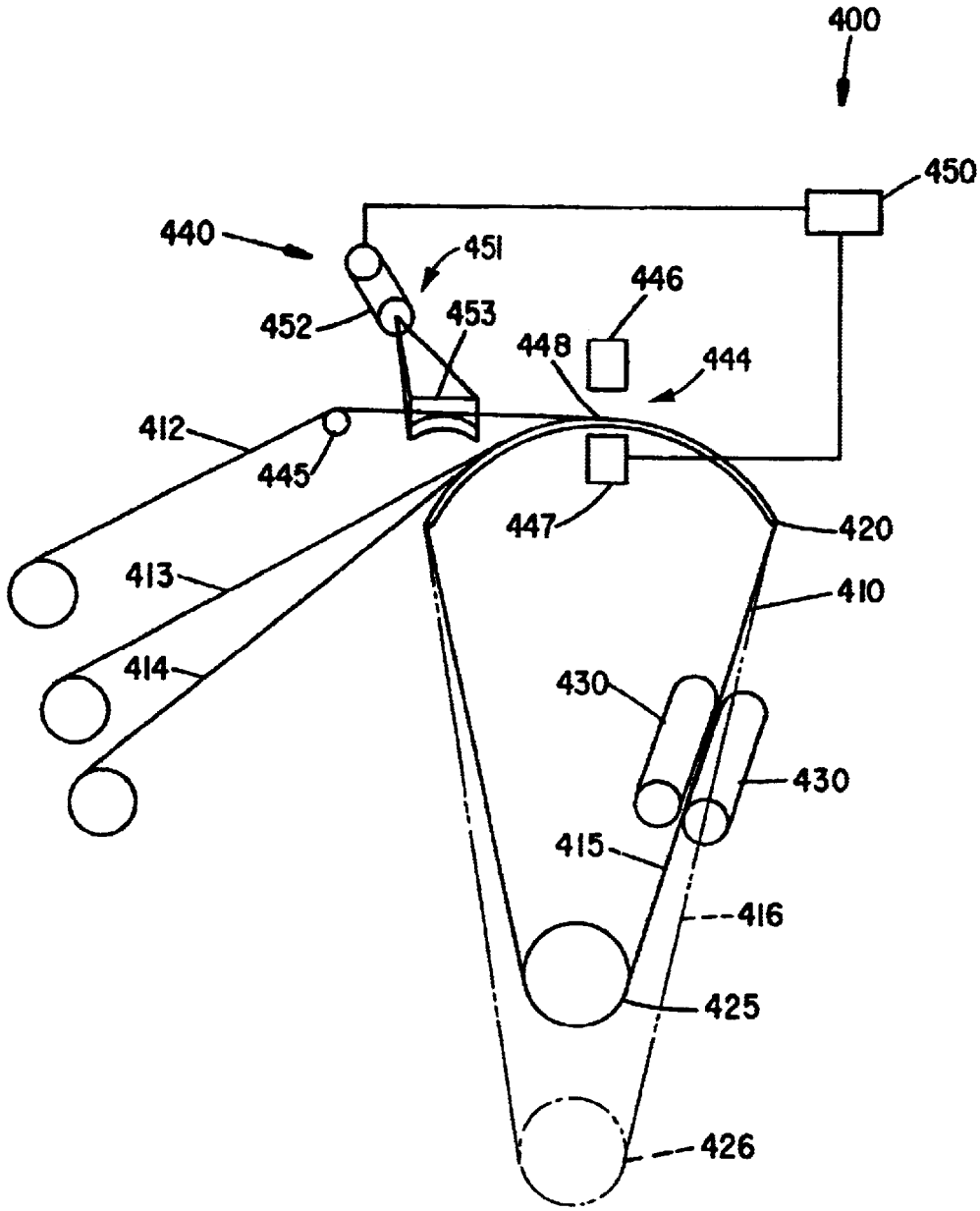
FIG. 10 is a diagram illustrating yet another embodiment of a spiral wound abrasive forming apparatus.

FIG. 10 is a diagram of yet another embodiment of a spiral wound abrasive belt winding apparatus 400 configured to accept a plurality of webs, such as webs 412, 413, 414, that simultaneously form an abrasive media 410 and a spiral belt 415. As described above, the outermost web 412 is preferably a coated abrasive, the middle web 413 is preferably an adhesive layer, and the innermost web 414 is preferably a reinforcing layer, however other numbers and types of webs may also be used. The three webs 412, 413, 414 are wound over a stationary first hub 420 that is mounted in a cantilevered manner. A moveably mounted second hub 425 provides tension for the spiral belt 415 and adjusts to accommodate spiral belts 415 of varying circumferences, as shown by phantom second hub 426 and belt 416.

In this embodiment, a pair of driven nip rollers 430 drives the abrasive media 410 in a winding spiral to form the spiral belt 415 and applies pressure to the abrasive media 410 to assist adhesion between the webs 412, 413, 414. The position and angle of the nip rollers 430 with respect to the abrasive media 410 may be adjusted to accommodate changes in the abrasive media 410 due to adjustment of the second hub 425, adjustments of the input angle of the webs 412, 413, 414, or other factors.

Significant gaps or web overlap at the spiral seam (not shown) of the spiral belt 415 will cause surface marks and other surface non-conformities in an item ground or polished by the spiral belt 415 in a subsequent operation. Therefore, minimization of gaps or overlap is necessary to provide an acceptable spiral belt 415. The apparatus 400 includes one embodiment of a gap minimization system 440 to monitor the spiral seam and correct unacceptable seam separation.

The gap minimization system 440 includes a sensing mechanism 444 that uses a light source 446 positioned on the outermost web 412 side of the abrasive media 410 at a point 448 where the outermost web 412 attaches to the middle web 413. The light source 446 may be visible light or may be infrared light, if desired. A light sensor 447 is positioned at the same point, but on side of the first hub 420 opposite the abrasive media 410. The light sensor 447 senses the amount of light shining through the gap at the seam of the outermost web 412. A controller 450 monitors the light sensor 447 and controls a positioning system 451 that adjusts the position of the outermost web 412 relative to the spiral belt 415, thereby adjusting the gap. The positioning system 451 includes a positioning motor 452 connected to the controller 450 and a web movement mechanism 453 driven by the positioning motor 452. In order to better accommodate changes in the position of the outermost web 412, a steering roller 445 is included to route the outermost web 412 through the web movement mechanism 453. With such a gap minimization system 440, the light source 446 should be strong enough to pass a small amount of light through an optimized seam so that no light may be construed to be web overlap.

It is to be understood that other embodiments of a gap minimization system are possible and are within the spirit and scope of the present invention. For example, the visible light source 446 and light sensor 447 may be switched such that the light shines up through the abrasive media 410, thereby allowing an operator to monitor the light passing through the seam, as well. In addition, the web movement mechanism 453 may be only a push plate that can move the web in one direction toward the spiral belt. In this situation, the outermost web should be initially set up with a small amount of gap to allow for such unidirectional adjustment.

Although the embodiments described above form a spiral abrasive belt from abrasive media including a coated abrasive web, it is to be understood that such a spiral belt may also be formed from non-coated abrasive media. The resulting spiral belt may then be used in operations requiring very light abrasion, such as the polishing or burnishing of leather, for example. Alternatively, the resulting spiral belt may be subsequently coated on the outer surface with abrasive particles to form a spiral wound abrasive belt with a coated abrasive surface.

The present invention provides a spiral wound abrasive belt that may be formed in a continuous manner, may be formed in varying circumferences, and may be slit to a large range of widths, as needed. The spiral belt may be constructed from abrasive media whose edges are joined together along a spiral seam, or may be constructed from individual webs that simultaneously form the abrasive media and the spiral belt. The webs used to construct the spiral belt may be chosen to optimize the strength and durability of the belt, thus producing abrasive belts with significantly longer lives, while minimizing the weight and other belt characteristics that impact installation and use of the belt in subsequent abrasive applications.

The methods of forming spiral wound abrasive belts and the apparatuses for practicing these methods in accordance with the present invention result in reduced labor and material costs. The methods and machines eliminate the need for multiple splices and custom sized equipment to form belts having the necessary circumference and width for a specific application. In addition, the offset layer process and equipment eliminate the need for any additional joining material and allow for the inclusion of all layers of the abrasive media into the spiral belt construction.

EXAMPLES

Example 1

A wide spiral wound abrasive belt that was about 1.32 meters (52 inches) wide by about 2.62 meters (103 inches) in circumference, was assembled using the apparatus 200, as shown in FIG. 7. The first web 212 was about 0.305 meters (12 inches) in width and was a coated abrasive formed from an outermost layer of 3M 961 UZ coated abrasive manufactured by 3M Company of St. Paul, Minn., a paper coated with abrasive particles, a middle layer of SURLYN hot melt adhesive pre-cast film, and an innermost layer of a nonwoven material, CEREX 2320 (plain) and T70 ORION fabric (DN style with diamond pattern), both fabricated by Cerex Advanced Fabrics of Pensacola, Fla., using a spunbond process. Both webs made from nylon fiber.

The second web 214 was a splicing material that was formed from a 0.5 mil polyester film having a width of about 0.305 meters (12 inches). The film was top coated with UV-curable adhesive. Prior to winding of the spiral belt, the splicing material was attached to the underside of the coated abrasive web, that is to the nonwoven material, at one edge along the length of the web, thereby forming the abrasive media 210. About one half of the width of the splicing material coated with adhesive was left exposed along the edge.

The abrasive media 210 was hand fed into the apparatus 200 and spirally wound about the hub 220 by a first operator. A second operator manually drove the driven press roller 235, and the press rollers 235, 236, 237 bonded the coated abrasive to the splicing media along the spiral seam 216. The resulting spiral abrasive belt was later evaluated for performance and reliability characteristics.

Although the present invention has been described with reference to preferred embodiments, workers skilled in the art will recognize that changes may be made in form and detail without departing from the spirit and scope of the invention. In addition, the invention is not to be taken as limited to all of the details thereof as modifications and variations thereof may be made without departing from the spirit or scope of the invention.

What is claimed is:

1. An endless spiral wound abrasive article comprising:

at least one first elongate web including a first surface and a second surface and having elongated side edges, wherein the first elongate web comprises a coated abrasive including at least one layer of abrasive particles on the first surface; and at least one second elongate web having elongated side edges, the second elongate web positioned adjacent to the second surface but offset from at least one of the side edges of the first elongate web, wherein the second elongate web comprises an adhesive layer, the second elongate web configured to adhere at least in part to the second surface of the first elongate web along one of the side edges, the first and second elongate webs wound at an angle in a spiral configuration to form an endless spiral wound article, wherein the side edges of the first elongate web abut and are joined by the second elongate web overlapping the abutted side edges of the first elongate web.

2. The spiral wound abrasive article of claim 1, wherein the second elongate web comprises a splicing portion positioned to join the abutted side edges of the first elongate web.

3. The spiral wound abrasive article of claim 2, wherein the splicing portion comprises a splicing media strip that is substantially narrower in width than the first elongate web.

4. The spiral wound abrasive article of claim 3, wherein the splicing media strip is offset from one of the side edges of the first elongate web about one half the width of the splicing media strip.

5. The spiral wound abrasive article of claim 3, wherein the splicing media comprises a polymeric film.

6. The spiral wound abrasive article of claim 1, wherein the first elongate web comprises at least two layers laminated together to form the coated abrasive.

7. The spiral wound abrasive article of claim 6, wherein the coated abrasive comprises a first abrasive layer, a second adhesive layer and a third reinforcing layer.

8. The spiral wound abrasive article of claim 7, wherein the second adhesive layer comprises an adhesive material chosen from the group consisting of thermoplastics, urethanes, epoxies, ethylene acrylic acids, radiation curable resins, pressure sensitive adhesives, latex, polyvinylacetate, and polyvinylacrylic acids.

9. The spiral wound abrasive article of claim 7, wherein the third reinforcing layer comprises a reinforcing material chosen from the group consisting of woven, nonwoven and film materials.

10. The spiral wound abrasive article of claim 1, wherein the first surface of the first elongate web forms an outer surface of the spiral wound article and wherein the outer surface is adapted to be coated with abrasive material subsequent to formation of the spiral wound article.

11. The spiral wound abrasive article of claim 1, further comprising at least one third elongate web having elongated side edges, the third elongate web positioned adjacent to the second elongate web but offset from at least one of the side edges of the second elongate web, with the second elongate web further configured to adhere at least in part to a surface of the third elongate web, the third elongate web wound at an angle in a spiral configuration along with the first and second elongate webs to form the endless spiral wound article, wherein the side edges of the third elongate web also abut and are joined by the second elongate web overlapping the abutted side edges of the third elongate web.

12. The spiral wound abrasive article of claim 11, wherein the third elongate web comprises a reinforcing layer

13. The spiral wound abrasive article of claim 12, wherein the reinforcing layer comprises a reinforcing material chosen from the group consisting of woven, nonwoven and film materials.

14. The spiral wound abrasive article of claim 11, wherein the first surface of the first elongate web forms an outer surface of the spiral wound article and wherein the outer surface is adapted to be coated with abrasive material subsequent to formation of the spiral wound article.

15. The spiral wound abrasive article of claim 11, further comprising at least one additional elongate web positioned adjacent to the next preceding elongate web that has elongated side edges, but offset from at least one of the side edges of the preceding elongate web, the additional elongate web wound at an angle in a spiral configuration along with the preceding elongate webs to form the endless spiral wound article, wherein the side edges of the additional elongate web also abut and are joined by the preceding elongate web overlapping the abutted side edges of the additional elongate web.

16. The spiral wound abrasive article of claim 1, wherein the side edges of the second elongate web abut.

17. The spiral wound abrasive article of claim 1, wherein the first and second elongate webs are wound at an angle between about 7° and about 21°.

18. The spiral wound abrasive article of claim 1, wherein the first elongate web comprises at least two layers laminated together to form the coated abrasive.

19. The spiral wound abrasive article of claim 18, wherein the coated abrasive comprises a first abrasive layer, a second adhesive layer and a third reinforcing layer.

20. An endless spiral wound abrasive article comprising:

at least one first elongate web including a first surface and a second surface and having elongated side edges; and at least one second elongate web having elongated side edges, the second elongate web positioned adjacent to the second surface but offset from at least one of the side edges of the first elongate web, the second elongate web configured to adhere at least in part to the second surface of the first elongate web along one of the side edges, the first and second elongate webs wound at an angle in a spiral configuration to form an endless spiral wound article, wherein the side edges of the first elongate web abut and are joined by the second elongate web overlapping the abutted side edges of the first elongate web, wherein the second elongate web comprises a splicing portion positioned to join the abutted side edges of the first elongate web and a reinforcing portion configured to reinforce the first elongate web, wherein the reinforcing portion and the splicing portion of the second elongate web comprise separate structures.

21. The spiral wound abrasive article of claim 20, wherein the second elongate web comprises at least one adhesive surface positioned to adhere to the first elongate web and join the abutted side edges of the first elongate web.

22. The spiral wound abrasive article of claim 20, wherein the reinforcing portion comprises a reinforcing material chosen from the group consisting of woven, nonwoven and film materials, and the splicing portion comprises a splicing media.

23. The spiral wound abrasive article of claim 20, wherein the first elongate web comprises a coated abrasive including at least one layer of abrasive particles on the first surface.

24. The spiral wound abrasive article of claim 20, wherein the second elongate web comprises an adhesive layer.

25. The spiral wound abrasive article of claim 20, wherein the side edges of the second elongate web abut.

26. An endless spiral wound abrasive article comprising:

at least one first elongate web including a first surface and a second surface and having elongated side edges; and at least one second elongate web having elongated side edges, the second elongate web positioned adjacent to the second surface but offset from at least one of the side edges of the first elongate web, the second elongate web configured to adhere at least in part to the second surface of the first elongate web along one of the side edges, the first and second elongate webs wound at an angle in a spiral configuration to form an endless spiral wound article, wherein the side edges of the first elongate web abut and are joined by the second elongate web overlapping the abutted side edges of the first elongate web, wherein the second elongate web comprises a splicing portion positioned to join the abutted side edges of the first elongate web and a reinforcing portion configured to reinforce the first elongate web, wherein the reinforcing portion and the splicing portion of the second elongate web comprise integral structure.

27. The spiral wound abrasive article of claim 26, wherein the second elongate web comprises a reinforcing material chosen from the group consisting of woven, nonwoven and film materials.

28. The spiral wound abrasive article of claim 26, wherein the second elongate web is substantially equal in width to the first elongate web.

29. The spiral wound abrasive article of claim 26, wherein the second elongate web is offset from one of the side edges of the first elongate web about one half the width of the second elongate web.

30. The spiral wound abrasive article of claim 26, wherein the side edges of the second elongate web abut.

31. An endless spiral wound abrasive article comprising:

at least one first elongate web including a first surface and a second surface and having elongated side edges;

at least one second elongate web having elongated side edges, the second elongate web positioned adjacent to the second surface but offset from at least one of the side edges of the first elongate web, the second elongate web configured to adhere at least in part to the second surface of the first elongate web along one of the side edges, wherein the second elongate web comprises an adhesive layer which comprises an adhesive material chosen from the group consisting of thermoplastics, urethanes, epoxies, ethylene acrylic acids, radiation curable resins, pressure sensitive adhesives, latex, polyvinylacetate and polyvinylacrylic acids; and at least one third elongate web having elongated side edges, the third elongate web positioned adjacent to the second elongate web but offset from at least one of the side edges of the second elongate web, with the second elongate web further configured to adhere at least in part to a surface of the third elongate web, the first, second and third elongate webs wound at an angle in a spiral configuration to form an endless spiral wound article, wherein the side edges of the first elongate web abut and are joined by the second elongate web overlapping the abutted side edges of the first elongate web, and wherein the side edges of the third elongate web also abut and are joined by the second elongate web overlapping the abutted side edges of the third elongate web.

32. An endless spiral wound abrasive article comprising:

at least one first elongate web including a first surface and a second surface and having elongated side edges;

at least one second elongate web having elongated side edges, the second elongate web positioned adjacent to the second surface but offset from at least one of the side edges of the first elongate web, the second elongate web configured to adhere at least in part to the second surface of the first elongate web along one of the side edges; and at least one third elongate web having elongated side edges, the third elongate web positioned adjacent to the second elongate web but offset from at least one of the side edges of the second elongate web, with the second elongate web further configured to adhere at least in part to a surface of the third elongate web, the first, second and third elongate webs wound at an angle in a spiral configuration to form an endless spiral wound article, wherein the side edges of the first elongate web abut and are joined by the second elongate web overlapping the abutted side edges of the first elongate web, and wherein the side edges of the third elongate web also abut and are joined by the second elongate web overlapping the abutted side edges of the third elongate web, and wherein the first elongate web comprises a coated abrasive, the second elongate web comprises an adhesive layer and the third elongate web comprises a reinforcing layer, wherein the coated abrasive includes at least one layer of abrasive particles on the first surface, the adhesive layer comprises an adhesive material chosen from the group consisting of thermoplastics, urethanes, epoxies, ethyleneacrylic acids, radiation curable resins, pressure sensitive adhesives, latex, polyvinylacetate and polyvinylacrylic acids, and the reinforcing layer comprises a reinforcing material chosen from the group consisting of woven, nonwoven and film materials.

33. A method for forming a spiral wound endless abrasive article comprising the steps of:

providing a first elongate web having a first surface, a second surface, and elongated side edges;

providing a second elongate web having elongated side edges;

positioning the second elongate web adjacent the first elongate web in a configuration offset from at least one of the side edges of the first elongate web;

providing first and second spaced apart hubs; and winding the first and second elongate webs in a spiral manner around the first and second hubs while abutting the side edges of the first elongate web and joining the abutted side edges of the first elongate web by overlap of the second elongate web to form an endless spiral wound article.

34. The method of claim 33, further comprising the step of coating an abrasive material onto the first surface of the first elongate web after winding the first and second elongate webs to form the endless spiral wound article.

35. The method of claim 33, further comprising the step of joining the first and second elongate webs after positioning the second elongate web adjacent to the first elongate web.

36. The method of claim 33, further comprising the steps of:

providing a third elongate web having elongated side edges; and positioning the third elongate web adjacent the second elongate web in a configuration offset from at least one of the side edges of the second elongate web; and wherein the step of winding further comprises winding the third elongate web around the first and second hubs along with the first and second elongate web while abutting the side edges of the third elongate web and joining the abutted side edges of the third elongate web by overlap of the second elongate web.

37. The method of claim 33, further comprising the step of adjusting the spacing between the first and second hubs.

38. The method of claim 33, further comprising the step of driving the endless spiral wound article in a winding spiral around the first and second hubs.

39. The method of claim 33, further comprising the step of applying pressure to the endless spiral wound article as it is wound around the first and second hubs.

40. A method for forming a spiral wound endless abrasive article comprising the steps of:

providing an abrasive media including an outermost web offset from but overlapping at least one adjacent web; and winding the abrasive media in a spiral manner around a pair of spaced apart hubs to form an endless spiral wound article wherein side edges of the outermost web abut and are joined by an overlap with the at least one adjacent web.

41. The method of claim 40, further comprising the step of joining the outermost web and at least one adjacent web together prior to winding.

42. The method of claim 40, wherein the step of winding further comprises the step of joining the outermost web and at least one adjacent web to form the abrasive article during winding.

43. The method of claim 40, further comprising the step of adjusting the spacing between the hubs.

44. The method of claim 40, further comprising the step of driving the endless spiral wound article in a winding spiral around the hubs.

45. The method of claim 40, further comprising the step of applying pressure to the endless spiral wound article as it is wound around the hubs.

* * * * *

UNITED STATES PATENT AND TRADEMARK OFFICE

CERTIFICATE OF CORRECTION

PATENT NO. : 6,780,096 B1
DATED : August 24, 2004
INVENTOR(S) : Brown, Ross A.

It is certified that error appears in the above-identified patent and that said Letters Patent is hereby corrected as shown below:

Column 4,
Line 50, after “itself” insert -- . --.

Column 8,
Lines 28 and 41, after “thereof” insert -- . --.

Column 9,
Line 62, after “mil” insert -- . --.

Column 11,
Line 64, after “220” delete “.”.

Column 15,
Line 12, after “web” insert -- including a first surface and a second surface and --.
Line 13, after "edges", insert -- the first surface of --.
Line 14, after “surface,” insert -- of the first elongate web --.
Line 15, after “wherein” insert -- the first surface of --.
Line 16, after “layer” insert -- the first surface of --.
Line 19, after “edges” delete “,” and insert -- of the first elongate web, --.

Column 16,
Line 5, after “layer” insert -- . --.

Signed and Sealed this

Second Day of August, 2005

JON W. DUDAS
*Director of the United States Patent and Trademark Office*